United States Patent [19]

Buckle

[11] Patent Number: 5,007,364

[45] Date of Patent: Apr. 16, 1991

[54] GAS CONTROL VALVES AND APPARATUS FOR CONTROLLING BUOYANCY IN WATER

[75] Inventor: Brian L. Buckle, Colwyn Bay, United Kingdom

[73] Assignee: Buoyco (M.M.) Limited, Clwyd, England

[21] Appl. No.: 385,021

[22] Filed: Jul. 26, 1989

[30] Foreign Application Priority Data

Jul. 26, 1988 [GB] United Kingdom ..... 8817737

[51] Int. Cl.[5] ..... B63G 8/22

[52] U.S. Cl. ..... 114/331; 114/52; 114/54; 114/333; 137/81.2

[58] Field of Search ..... 114/330, 331, 333, 52, 114/53, 54; 441/21, 29, 30; 405/193, 186; 137/81.2

[56] References Cited

U.S. PATENT DOCUMENTS

| | | | |
|---|---|---|---|
| 3,436,776 | 4/1969 | Davis | 114/331 |
| 3,659,299 | 5/1972 | Davidson et al. | 114/54 X |
| 3,952,349 | 4/1976 | Erath et al. | 114/331 |
| 4,121,529 | 10/1978 | Smith et al. | 114/331 X |
| 4,527,582 | 7/1985 | Buckle et al. | 137/81.2 |
| 4,674,429 | 6/1987 | Buckle et al. | 114/331 X |
| 4,677,931 | 7/1987 | Buckle | 114/331 |

FOREIGN PATENT DOCUMENTS

87/06557 11/1987 World Int. Prop. O. .

*Primary Examiner*—Sherman Basinger
*Attorney, Agent, or Firm*—Cushman, Darby & Cushman

[57] ABSTRACT

A gas control valve (802) has an inlet needle jet (812) and an outlet (816), the communication between which is controlled by a valve member (808) carried by a rod (807) connected to a diaphragm (804) which divides a chamber (806), open to ambient pressure, from a chamber (805) which has an inlet connected to a buoyancy chamber (100) of buoyancy apparatus in which the valve is incorporated. The inlet (816) is also connected to the buoyancy chamber (100). By the inclusion of an ascent sensing control valve (801) sensing to trigger a venting valve (106), the buoyancy control apparatus is capable of producing hovering in water.

4 Claims, 9 Drawing Sheets

GAS CONTROL VALVES AND APPARATUS FOR CONTROLLING BUOYANCY IN WATER

FIELD OF THE INVENTION

The present invention relates to apparatus for controlling buoyancy, e.g. for producing hovering in water.

BACKGROUND OF THE INVENTION

GB-A-2182892 discloses buoyancy apparatus for carrying a pay-load to and maintaining the pay-load at a predetermined depth. The apparatus described operates by sensing upward movement and downward movement of the buoyancy apparatus in water and injecting air into or venting air from a ballast tank to adjust the buoyancy of the device to maintain a constant depth.

It is also disclosed that such a device can be made to work using means for sensing movement in either the upward direction or the downward direction but not both. However, no specific apparatus working according to this principle is disclosed.

SUMMARY OF THE INVENTION

The present invention provides apparatus for use in controlling buoyancy in water comprising a buoyancy chamber for containing a variable volume of gas, means for supplying buoyancy gas to said chamber, first valve means for controlling said supply of gas, second valve means for controlling venting of gas from said chamber, at least one out of said first and said second valve means comprising a gas control valve having an inlet connected to a gas supply, an outlet for gas from said valve, and a sensing inlet connected to said volume of gas in the buoyancy chamber, and having open and closed positions between which said control valve is shiftable to open or to close a flow path between said gas supply and said outlet in response to a predetermined value of the differential between air pressure in said buoyancy chamber and ambient water pressure at said control valve.

DESCRIPTION OF PREFERRED FEATURES OF THE INVENTION

The said control valve may be provided in said first valve means connected so as to limit the pressure with respect to ambient at the control valve to which the said volume of gas may be pressurised by the supply of gas. For this purpose the control valve will be of the "normally open" type. Alternatively, the said control valve may be provided in said second valve means so connected as to actuate a pneumatically actuated venting valve to vent gas from the chamber upon the chamber pressure reaching a predetermined value above ambient at said control valve. For this purpose the control valve will be of the "normally closed" type. In each case, the control valve is operated by gas pressure in the chamber to close a normally open control valve or to open a normally closed control valve.

The chamber is preferably expansible, e.g. is an inflatable bag. Filling of such a chamber will produce a progressive rise in pressure in the chamber with respect to ambient.

A rigid walled chamber may have an inlet/outlet for water to allow the chamber to be progressively filled by gas displacing water from the chamber and a valve means serving to close the water inlet/outlet against at least outward water flow when the volume of air in the chamber has increased sufficiently to make the apparatus buoyant.

The introduction of further gas into the chamber or ascent of the apparatus will then produce a rise in gas pressure therein with respect to ambient pressure. The valve means for venting water may respond to water depth, closing when the apparatus is below a predetermined depth, it being calculated that by the time the apparatus has sunk to such a depth, the chamber will have been sufficiently filled with gas for the apparatus to be positively buoyant although still sinking for the moment by virtue of inertia.

The valve means for venting water is more preferably controlled by a descent sensing means serving to open the valve means while descent is timed so as to allow air to be introduced into the chamber.

One may also employ a cylinder closed by a piston to define a variable volume gas chamber. The piston may be displaced against ambient water pressure until it reaches a stop at which the chamber volume is at a maximum chosen to be enough to provide positive buoyancy. Introducing further gas will produce a rise in chamber pressure with respect to ambient.

A still further alternative would be to employ a chamber divided suitably across its centre by a flexible diaphragm in the form of a cup. Preferably the cup will extend down to a base wall of the chamber and will be supported thereon filling the lower half of the chamber when the space above the diaphragm is filled with gas, the base wall having an inlet/outlet for water.

Preferably, the gas control valve of the apparatus comprises a valve body, an inlet for gas to said valve body, an outlet for gas from said valve body, a gas flow path within said valve body from said inlet to said outlet, a valve member movable between a valve open position in which gas flow from said inlet to said outlet is permitted along said flow path and a valve shut position in which the valve member closes said flow-path, a pressure sensing member in sealing communication with gas pressure in said chamber and also in communication with ambient pressure and mounted so as to be deflectable by the differential between said gas pressure and ambient, and means connecting said pressure sensing member to said valve member, the arrangement being such that deflection of the pressure sensing member in response to a predetermined excess of chamber pressure over ambient pressure causes said valve member to move between said valve open and valve shut positions to open or to close said flow path for gas through said valve.

The pressure sensing member may be a diaphragm or a piston or a system of mechanically, pneumatically or hydraulically linked diaphragms and/or pistons.

The control valve may comprise a valve chamber divided in a gas-tight manner into a first and a second compartment by said diaphragm or piston, the first compartment being in gas pressure communicating connection with said buoyancy chamber and the second compartment being in pressure communicating connection with ambient pressure.

The valve member may be mounted on said diaphragm or piston or on a valve stem connected to said diaphragm or piston.

The inlet to the control valve may comprise a needle jet closeable by said valve member, thus reducing the force which needs to be applied to the pressure sensing member by the said differential pressure in order to succeed in closing off the inlet.

The valve member may be biased away from the inlet to the control valve by a spring biasing member, e.g. a spring acting between the valve body and the second face of the pressure sensing member so that the control valve is "normally open".

Alternatively, the valve member may be biased towards the inlet to the control valve by a spring biasing member so that the control valve is "normally closed". In each case pressure applied to the pressure sensing member should deflect it against said spring bias.

The invention includes apparatus as described above wherein said outlet from said control valve is connected to supply gas to said volume of gas in said buoyancy chamber and said control valve is shifted to said closed position in response to said pressure differential rising to said predetermined value.

Preferably, such apparatus further includes means for sensing ascent of the apparatus in water connected to operate said second valve means to produce venting of gas from said buoyancy chamber.

In a second aspect, the invention provides apparatus for producing hovering in water comprising a buoyancy chamber, first valve means for controlling a supply of gas to said buoyancy chamber, a gas control valve for sensing the occurrence of a condition in which the gas pressure in said chamber exceeds ambient pressure by a predetermined amount and cutting off the admission of gas to said chamber whilst said condition persists, means for sensing ascent of the apparatus and second valve means responsive to said ascent sensing means for venting gas from said chamber in response to sensing ascent.

Preferably, the means for sensing ascent comprises means monitoring the rate of ascent sensitive to reactive thrust of water on the said means consequent upon the rate of ascent and providing a control signal when the ascent speed exceeds a predetermined value, and a gas control valve responsive to said signal to provide a pneumatic actuation signal to said second valve means, connected to said second valve means, said second valve means being responsive to said signal to vent gas from the chamber to reduce the buoyancy and comprising a pneumatically actuable venting valve adapted to vent gas from the gas chamber when actuated.

The monitoring means may comprise a diaphragm exposed at one face to the ambient water in use and so disposed that movement in the device in the ascent direction urges the diaphragm to deflect.

The other face of the diaphragm may also be open to ambient water.

The control signal may be provided by movement an actuating member extending from and movable with the diaphragm.

The actuating member may act directly upon the gas control valve responsive to said ascent signal.

The gas control valve responsive to the ascent signal is preferably and normally a two-way poppet-type whisker valve in which the whisker is engaged by the actuating member.

The means for sensing ascent may provide a control signal when the ascent velocity exceeds a predetermined value, and may be connected to said second valve means controlling the venting of gas from the buoyancy chamber, said second valve means being responsive to said control signal to vent gas from the chamber to reduce buoyancy. The ascent sensing means may have a velocity member exposed to upward flow of water relative to the apparatus supported in an equilibrium position for deflection by said upward flow of water, said velocity member being exposed at one face to the water whereby sufficiently rapid movement of the device in the ascent direction urges movement of the velocity member to produce said control signal, wherein the monitoring means also comprises a control valve comprising an inlet for connection to a source of pressurised gas, a chamber communicating with said inlet and containing a piston moveable between a valve-closed position and a valve-open position, a gas supply line for communicating said control signal to said second valve means exiting from said piston containing chamber, there being a flow-path of gas from said inlet to said gas supply line which is shut off from said inlet when the piston is in the valve-closed position and open for gas flow from said inlet when the piston is in the valve-open position, a valved outlet for said piston containing chamber remote from the said inlet and normally closed by a valve, said valve being operable by movement of said velocity member to open the valve, gas bleed means providing restricted gas communication from said inlet to the face of the piston remote from the inlet, and biasing means biasing the piston towards the valve-closed position, whereby upon opening of the valve which normally closes the said valved outlet by movement of the velocity member, the piston is displaced to the valve-open position by gas pressure from said inlet to communicate said inlet and gas supply line, and wherein the second valve means controlling the venting of gas from the gas chamber is responsive to gas pressure in gas supply line as said control signal to produce said venting.

The velocity member preferably has a rigid actuating member extending from it and movable with it to act directly or indirectly on the control valve.

The valve of said valve outlet of said piston containing chamber may be a whisker valve having a valve stem connected to the velocity member and a valve head and seat adapted to be unseated by deflection of the valve stem.

The invention provides in a third aspect—apparatus for producing hovering in water comprising a buoyancy chamber, first valve means for controlling a supply of gas to said buoyancy chamber, second valve means for controlling venting of gas from said chamber, said second valve means comprising a pneumatically actuable venting valve and a gas control valve for sensing the occurrence of a condition in which the gas pressure in said chamber exceeds ambient water pressure by a predetermined amount and for communicating gas from a supply of gas to said pneumatically actuable venting valve to open the venting valve to vent gas from said chamber whilst said condition persists, and means for sensing descent of the apparatus and for actuating said first valve means to release gas into said buoyancy chamber.

Preferably, the means for sensing descent comprises means monitoring the rate of descent sensitive to reactive thrust of water on the said means consequent upon the rate of descent and providing a control signal when the descent speed exceeds a predetermined value, and a gas control valve responsive to said signal to open communication between said supply of gas and said buoyancy chamber.

Optionally said buoyancy chamber is of substantially fixed volume and is provided with third valve means responsive to pneumatic control signals to open a communication between a lower portion of said chamber and ambient water to allow the flow of water into and out of said chamber when the volume of gas in said chamber is to be varied.

Preferably said third valve means has an inlet for receiving said pneumatic actuation signal connected to said outlet of said gas control valve of the first or second valve means.

The invention includes buoyancy apparatus for carrying a pay-load to and maintaining the pay-load at a substantially constant depth or within a desired range of depth incorporating apparatus for producing hovering in accordance with the invention as described above or including apparatus for producing buoyancy as described above.

The invention includes also a water craft incorporating apparatus as described above enabling the water craft to hover submerged in water whether at a constant depth or within a desired range of depth, or including apparatus for controlling buoyancy as described above.

In a further aspect, the invention includes a control valve comprising a valve body, an inlet to said valve body for pressurising gas, an outlet for pressurising gas from said valve body, a gas flow-path within said valve body from said inlet to said outlet, a valve member mounted within said valve body and movable between a valve open position and a valve closed position in which the valve member co-acts with a valve seat in said flow-path to close said flow-path, a gas pressure deflectable pressure sensing member connected to said valve member and mounted to the valve body, means for connecting said pressure sensing member to close an outlet from a chamber to be pressurised in use by said pressurising gas, the pressure sensing member being deflectable by gas pressure in said chamber to be pressurised when in use whereby to move said valve member from one of said open and said closed positions to the other thereof to close or to open the supply of gas to said chamber to be pressurised.

The pressure limiting valve may further have the preferred and optional characteristics indicated above in respect of the inflation limiting valve of the first aspect of the invention.

BRIEF DESCRIPTION OF THE DRAWINGS

The invention will be further illustrated by the following description of preferred embodiments with reference to the accompanying drawings in which.

DETAILED DESCRIPTION OF PREFERRED EMBODIMENTS

Figure 1:
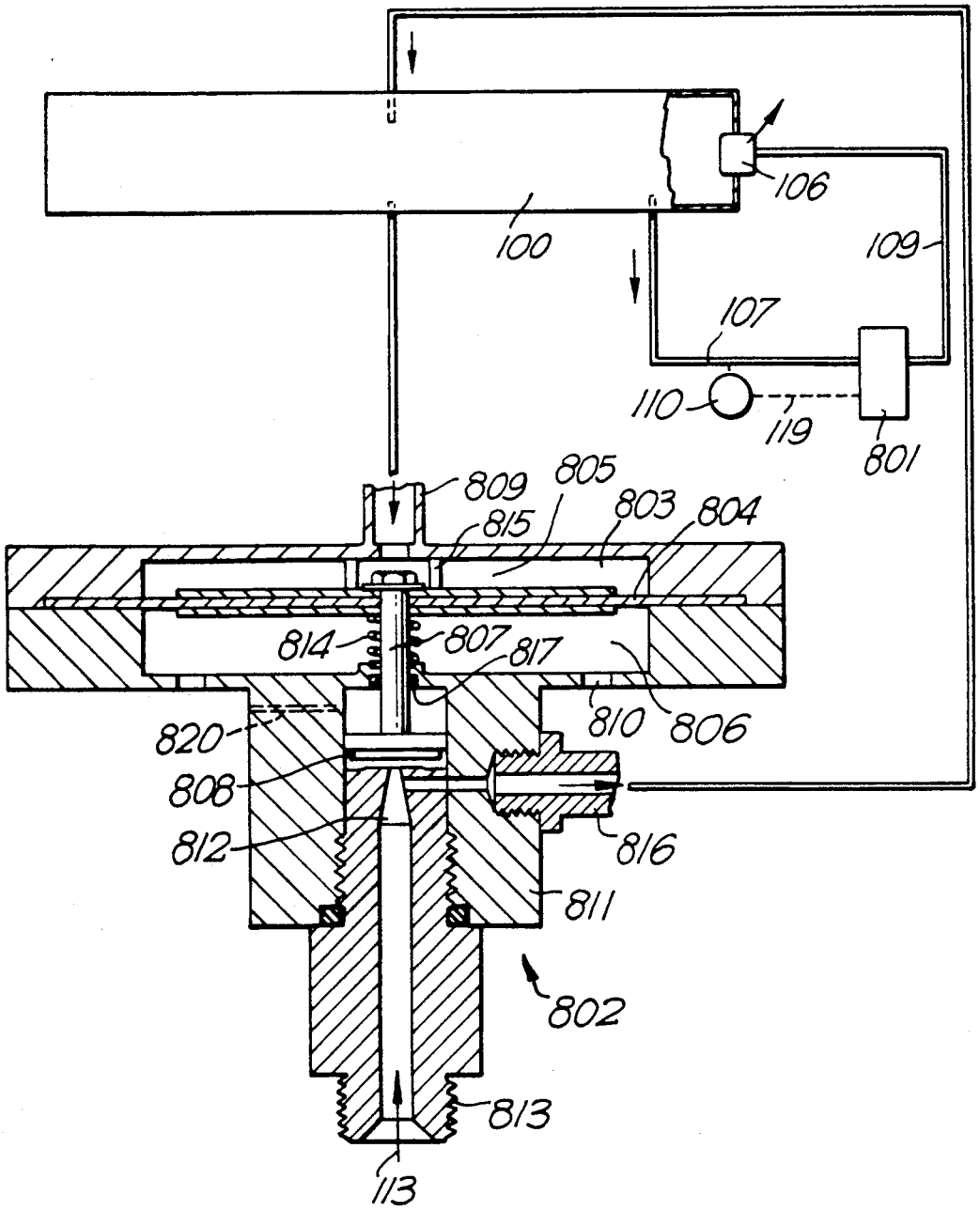
FIG. 1 is a schematic view of apparatus according to the invention with the pressure limiting valve thereof shown in schematic cross-sectional elevation.
Figure 2:
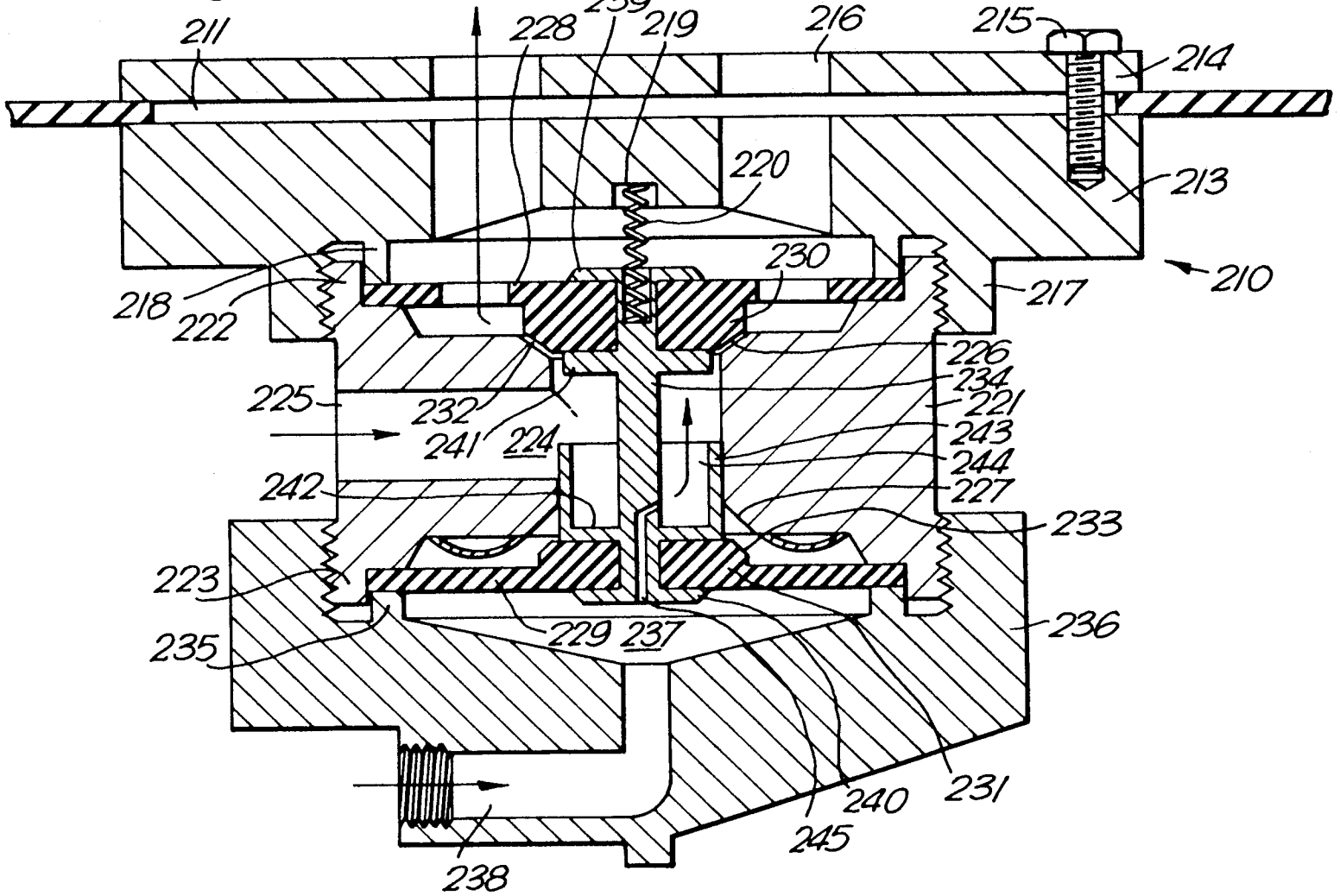
FIG. 2 shows in schematic cross-sectional elevation a venting valve for use in the apparatus of FIG. 1.
Figure 3:
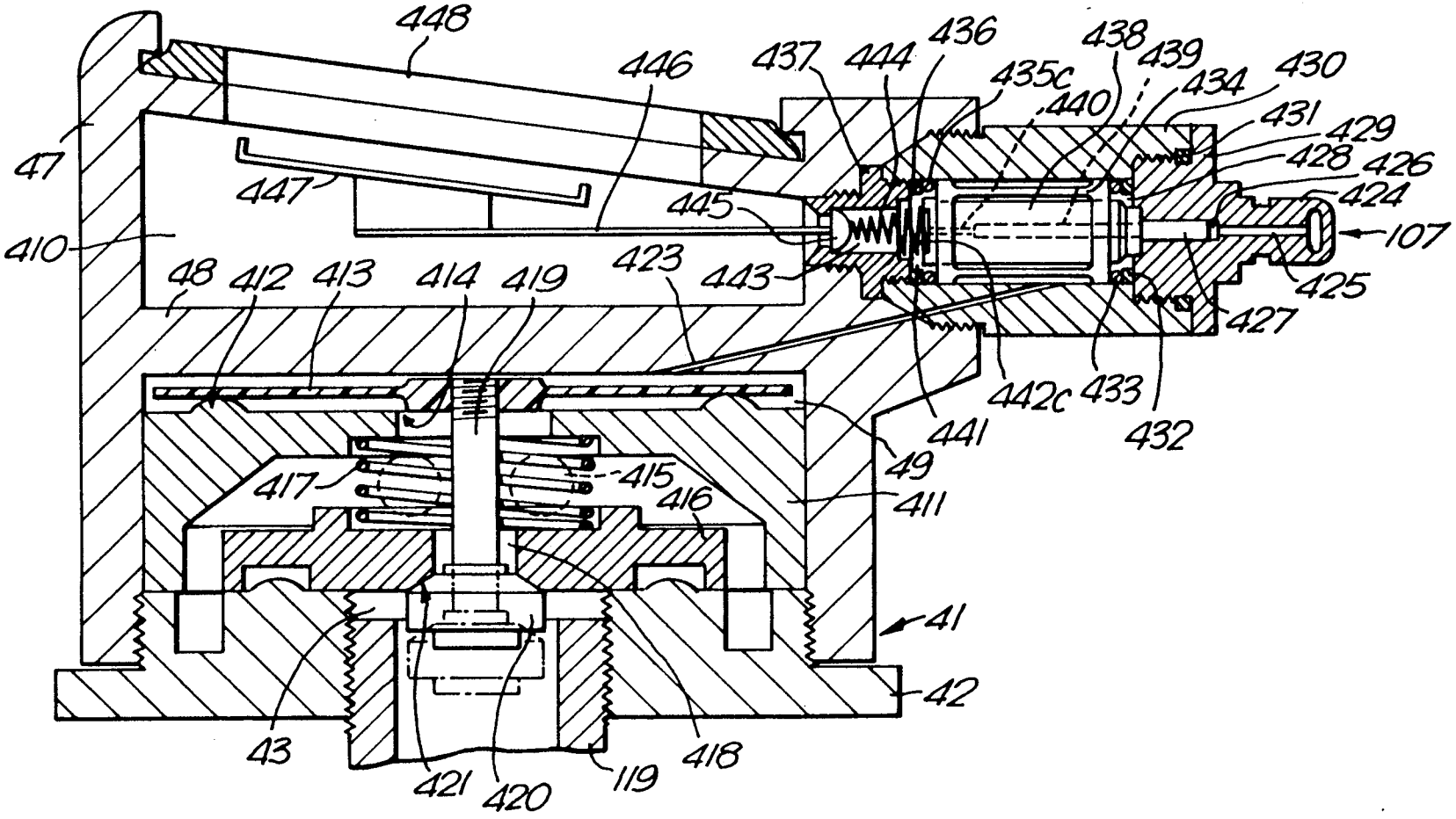
FIG. 3 shows in schematic cross-sectional elevation a ascent control valve for use in the apparatus of FIG. 1.
Figure 4:
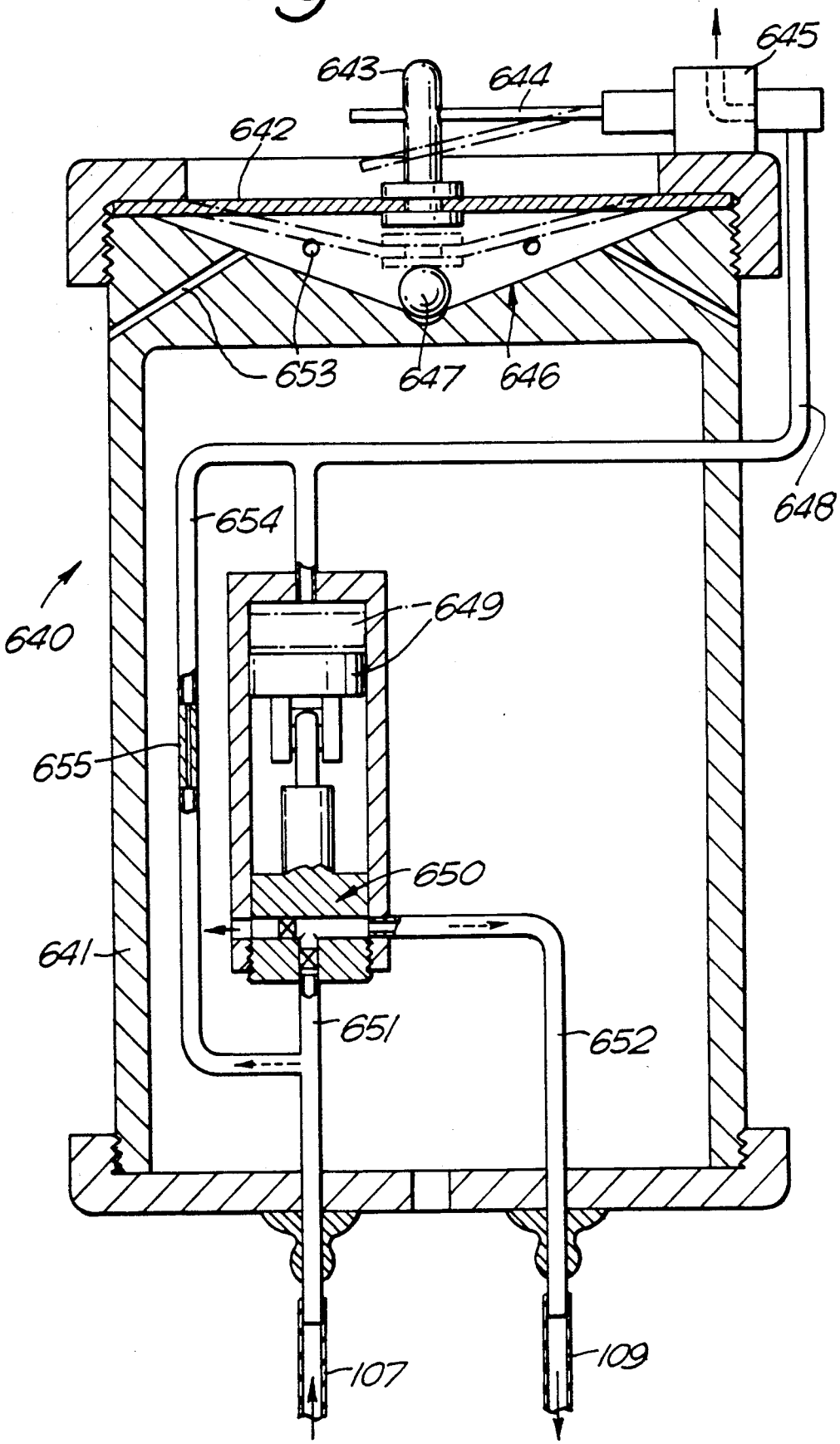
FIG. 4 shows in schematic cross-sectional elevation a second form of ascent control valve for use in the apparatus of FIG. 1.
Figure 5:
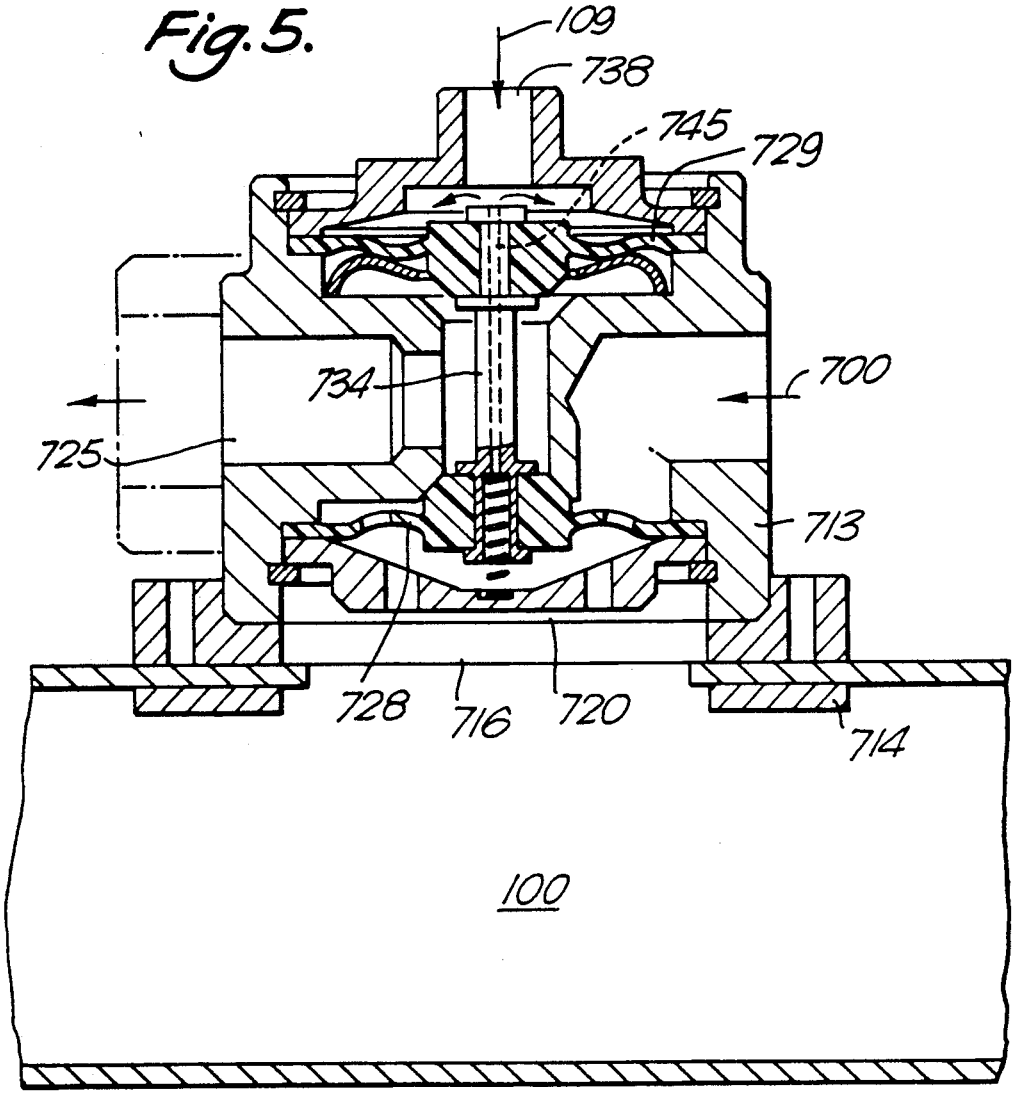
FIG. 5 shows an alternative form of venting valve for use in the apparatus of FIG. 1.

The hovering apparatus shown in FIG. 1 comprises an inflatable buoyancy chamber 100, and an ascent control valve 801 of the kind shown in FIG. 3 or FIG. 4 having an inlet for operating air pressure connected by a line 107 to chamber 100. Alternatively, the air supply to the ascent control valve may be from a separate source of air pressure or in common with that to the pressure limiting valve 802 described below. In the case of an the ascent control valve of the kind shown in FIG. 3, a further inlet to the ascent control valve is connected via a pressure reducing regulator 110 by a line 119 to the inflatable chamber 100. An outlet from the ascent control valve for communicating a pneumatic signal therefrom is connected to an actuating inlet 238 or 738 of a venting valve as illustrated in FIG. 2 or FIG. 5 via a line 109.

The hovering apparatus further comprises a control valve in the form of an inflation or pressure limiting valve 802 connected between a line 113 from a source of compressed air and the buoyancy chamber 100.

The valve 802 comprises a diaphragm chamber 803 divided by a flexible diaphragm 804 into upper chamber 805 and lower chamber 806. Diaphragm 804 carries a depending valve stem 807 terminating in a disc shaped valve washer 808. A sensing inlet for gas pressure from the buoyancy chamber 100 is provided at 809 in the upper chamber 805 Lower chamber 806 communicates with ambient water pressure via ports 810.

Valve stem 807 extends out of the lower chamber 806 axially along a valve body in the form of a large diameter tube 811. A needle jet 812, enters tube 811 from the opposite end and communicates with an inlet 813 for gas from line 113.

The centre of diaphragm 804 is biased upwardly by a coil spring 814 to rest against an annular stop 815. The diaphragm centre is displaceable downwardly to lower the valve washer 808 on to the needle jet 812 to block it.

An outlet 816 for air communicates with the interior of tube 811 and is connected to the inlet of the buoyancy chamber 100. Air can flow from line 113 to outlet 816 when the valve stem 807 is raised by spring 814.

Tube 811 is sealed from the ambient water pressure in lower chamber 806 by an O-ring 817.

A capillary gas bleed bore 820 may be provided through the tube 811. In the embodiment of FIG. 1 this would be capped but it is used in some of the embodiments described below.

FIG. 2 shows a venting valve for use in the invention to be positioned in the skin of the buoyancy chamber 100.

As shown in FIG. 2, venting valve apparatus 210 is mounted over a circular aperture 211 in the inflatable chamber. The apparatus comprises a first body portion 213 generally circular in shape mounted to the internal side of the chamber 100 over the aperture 211 and a mounting disc 214 of size corresponding to the first body portion 213 bolted thereto by bolts 215 located around the periphery of the mounting disc 214. The mounting disc 214 and the first body portion 213 are provided respectively with a ring of through apertures 216 which overlap to provide a gas flow path through the assembly of the mounting disc and first body portion.

The first body portion 213 has on its face remote from the mounting disc 214 an upstanding cylindrical flange 217 which is threaded on its internal cylindrical face. Concentric with flange 217 and spaced therefrom by an annular gap is a second upstanding cylindrical flange 218. Inboard of the circular flange 218, the surface of the first body portion is dished and in a central region there is provided a cup 219 for receiving one end of a compression coil spring 220.

Screwed into the thread in the flange 217 is a generally cylindrical valve body member 221 having outwardly threaded portions on either end. The top and bottom surfaces of the valve body member are inwardly recessed and surrounded by peripheral flanges 222, 223. A central wide bore 224 extends axially through the valve body. A transverse radially extending bore 225 extends generally centrally intermediate the ends of the cylindrical valve body member communicating the exterior cylindrical face with the central bore. The transverse bore is defined laterally by a pair of radii of the cylindrical valve body member extending at a little under 90° to one another and the bore is divided by a radially running bulkhead (not shown) so as not unduly to weaken the valve body.

A pair of frusto-conical valve seats are provided in the valve body facing in opposite directions and located in the top and bottom surfaces of the valve body at 226, 227. For each valve seat there is provided a rubber diaphragm 228, 229 having a central cylindrical boss 230, 231 terminating in a frusto-conical valve member surface 232, 233 seated within a respective frusto-conical valve seat 226, 227. The two rubber diaphragms 228, 229 are joined by a centrally extending control rod 234 as will be described in more detail hereafter. Diaphragm 228 is apertured to allow air to flow therethrough.

The periphery of diaphragm 228 is sandwiched between the recessed top surface of the valve body member 221 and the bottom surface of the inner cylindrical flange 218 of the first body member 213.

Similarly, the diaphragm 229 is, at its periphery, sandwiched between the bottom face of the cylindrical valve body member 221 and the upwardly facing surface of a cylindrical flange 235 provided in a valve cap member 236. Valve cap member 236 has an inwardly facing cylindrical wall portion threaded to mate with the respective end of the cylindrical valve body member 221 and the flange 235 is concentric therewith and spaced therefrom by an annular space. Inboard of the flange 235, the cap member 236 is dished to provide room for movement of the diaphragm 228 thereby defining a chamber 237 between the diaphragm 228 and the top wall of the cap member. A gas inlet passage 238 communicates from the exterior of the cap member to said chamber 237 and is provided with a suitable end fitting for receiving a connection to a conduit for the supply of gas thereto.

The control member 234 is provided with four radially outwardly protruding flanges spaced along its length. There are two end flanges 239, 240 at opposite ends thereof and two intermediate flanges 241, 242 located such that the central boss of each diaphragm 228, 229 is trapped between an end flange and an intermediate flange.

A cylindrical collar 243 extends upwardly from the flange 242 to approximately half way between flange 242 and flange 241 spaced from the control rod 234 by an annular gap 244. A bore 245 extends through the control member 234 from the chamber 237 running axially of the control member until just within the annular gap 244 between the control member 234 and the cylindrical collar 243. The bore then exists transversely from the control member on the side thereof opposite to the bore 225 of the valve body member 221 and in a direction somewhat toward the outlet from the annular gap 244.

It can be seen that coil spring 220 serves to bias the diaphragm 228 to close the valve seat 226 with the frusto-conical valve member surface 232.

The valve has a subsidiary role as a pressure relief valve. Excessive pressure in the buoyancy chamber will be communicated into the chamber 237 and will force up the diaphragm 229 whilst also acting on the valve member surface 232 to open the venting valve.

In use, to vent gas from the interior of the chamber, air pressure is applied to conduit 238 from the ascent control valve 801.

The effect of this is two-fold. First, the chamber 237 is sufficiently pressurised to deflect diaphragm 229 and hence diaphragm 228 upwardly to lift the valve member surface 232 off the valve seat 226 and open the valve provided by those members. This allows gas flow from the chamber 100 through the bore 225 and the valve means 226, 232 through the apertures 216, to atmosphere. In addition, air flows from the chamber 237 through the bore 245 to join the main flow path of gas entering through bore 225. It has been found that a venturi effect is produced which greatly assists evacuation of the chamber 100.

The extent of the venturi effect obtained depends to a substantial extent in practice upon the exact construction of the air bleed provided by the bore 245. It has been found very advantageous that the exit from the bore 245 is directed away from the bore 225 and that the exit is situated close to the intermediate flange 241. It has also been found advantageous that the cylindrical collar 243 does not extend substantially more than half way between the two intermediate flanges 241 and 242.

However, it is envisaged that many alternative constructions of the valve interior would produce the same effect. It may well be desirable to arrange that the flow of gas through the bore 245 can exit into the main flow path substantially directly upwardly toward the valve 226, 232 rather than through the side of the control rod 234 as illustrated. This might for instance be achieved by supporting the intermediate flange 241 by a spider connecting it to a shorter control rod 234 with the bore 245 extending axially throughout the control rod 234 to the end thereof at said spider.

Such valves are further described in WO-87/06557 and a second example is shown in FIG. 5.

Referring to FIG. 3 of the drawings, an ascent control valve generally indicated at 41 comprises an outer body 42 having a central passage 43 which is threaded to receive line 107 as an inlet for gas to the valve. On to the outer body 42 there is threaded a housing 47 having a transverse wall 48 which bounds a lower chamber 49 and an upper chamber 410. In the lower chamber 49 there is positioned a sealing plate 411 having an annular rib 412 on which rests a resiliently deformable diaphragm 413. The upper face of the diaphragm 413 is exposed to a residual fluid pressure present in the chamber 49. A pressure regulator 110 in line 107 transmits a reduced gas pressure via a branch line 119 to the inlet in the base of the ascent control valve. The under side of the diaphragm is in use subject to the fluid pressure in line 119, through passages 414 between the sealing plate 411 and the diaphragm 413, and the space below the diaphragm via holes 415 in the wall of the housing 47 communicating with a connection (not shown) to line 109. In the chamber 49, below the diaphragm 413, there is disposed a seal cap 416 which is urged downwardly by a compression spring 417, so as normally to seat on to the top of the body 42. The seal cap has a wide central aperture 418 within which there is disposed with clearance a stem 419 secured to the diaphragm 413 and which carries at its lower end a valve member 420 which in the rest condition seats on to a seating 421 on the seal cap 416 and prevents exit of gas fluid from line 107.

The chamber 49 communicates, through a passage 423 with an air supply controlled by a valve.

The valve has a snap-on connector 424 to receive an air hose (not shown) connected to line 107 which contains a higher pressure than line 119. From the connector 424, an air passage 425 leads through a filter 426 and a passage 427 to a piston chamber 428. The passages 425 and 427 are formed in a nut 429 threaded into a valve body 430, with an "O-ring" 431 between them. The piston chamber 428 formed in the body 430 contains a spacer washer 432 against which is seated an O-ring 433 abutted by one end of a spacer cage 434. The other end of the spacer cage abuts an O-ring 435 seated against a spacer washer 436 abutting a union 437 threaded into the body 430. Within the spacer cage 434 there is positioned a piston 438 having a first larger air passage 439 leading to a second smaller air passage 440 which opens into a space 441 containing a spring 442 which thrusts the piston to the right in this drawing. The space 441 opens into a slightly smaller passage 443 containing a spring 444, which thrusts a valve 445, on one end of a rigid actuator rod 446, into a closed position. At the other end of the rod 446 there is mounted a velocity disc plate 447.

When the whisker valve 445, 446 is closed, i.e. when the velocity member 447 is not deflected by rush of water against it, or is not deflected to a predetermined extent, the air pressures on each end of the piston 438 are balanced, and the spring 442 thrusts the piston into a closed position (to the right in this drawing) in which the piston closes off the passage 423. If the whisker valve is opened, as a result of deflection of the velocity member 447, there is a lowering of pressure in the space 441, with the result that the unbalance of pressures on the piston causes it to move to the left, in this drawing, thereby providing a flow path for gas to the passage 423 and permitting flow of air down the passage 423, to deflect the diaphragm 413 downwardly for actuation of the venting valve. As soon as deflection of the velocity member is terminated, as a result of reduction of buoyancy and thus of speed of rise in the water, the whisker valve closes again, and pressure at both ends of the piston become equalised, so that the spring 442 then returns the piston to the right and thereby closes off the passage 423.

The chamber 410 in which the velocity member 447 is positioned has an opening 448 through which the upper face of the velocity member 447 is exposed to the relative downward movement of water as the entire device rises under the effect of buoyancy. When the rate of rise exceeds a predetermined limit, the velocity member 447 permits entry of air to chamber 49. This depresses the diaphragm 413 and causes valve member 420 to be lowered away from the seating 421, thereby providing an escape path for air from the line 107 through the passage 422, past the seating 421, and out through the passages 415 into line 109 to venting valve 106. The resulting escape of air from the chamber 100 decreases the rate of ascent, and the force exerted on the velocity member 447 is accordingly reduced, so that the valve 445 eventually closes and the diaphragm 413 is allowed to return to its unconstrained condition and thereby lift the valve member 420 into sealing engagement with the seat 421.

Similar valves readily adapted for use in this invention are described in GB-2126534B.

An alternative form of ascent control valve for use in the invention is shown in FIG. 4.

Referring now to FIG. 4, an ascent control device of a second type is generally indicated at 640. The device comprises an elongate housing 641 which is open at its upper end to expose the upper face of a diaphragm 642. The diaphragm 642 has a central actuating stem 643 extending upwardly therefrom and movable therewith. The stem 643 has a lateral hole which receives the whisker 644 of a whisker valve 645. The valve 645 is a normally closed two-way poppet-type wisker valve arranged to exhaust to its surroundings. The inlet is connected to an air exhaust line 648.

A tapered seat 646 and ball 647 are provided below the diaphragm 642. Circumferentially spaced holes 653 communicate between the chamber under diaphragm 642 and ambient fluid.

The exhaust line 648 extends from a single acting spring return pilot actuator 649 arranged to act on a normally open three-way spool valve 650. The inlet of valve 650 is connected to air supply line 107 and the outlet is connected by line 109 to the pneumatically operated venting valve 106. A by-pass 654 including restrictor 655 connects the supply line 651 upstream of the valve 650 to the exhaust line 648.

In use, air supplied from the supply line 651 via the by-pass 654 maintains the actuator 649 in its extended position in which it bears against the operating stem of valve 650 to vent the line 652. When the diaphragm 642 is moved downwardly in response to ascent of the device to a sufficient extent to open the whisker valve 645, air is permitted to exhaust from the actuator 649 via the exhaust line 648. The piston of the actuator returns under its spring bias releasing the operating stem of the valve 650 and allowing the valve to return to its normal open condition in which it connects lines 651 and 652. The air passing through line 652 actuates the venting valve to vent air from the chamber 100.

The venting of air reduces the buoyancy and thereby decelerates ascent. The diaphragm 642 will then gradually return to its normal position and thereby close the whisker valve 645. Closure of the valve will cause a build-up of air pressure in the pilot actuator 649 moving the piston of that actuator to close the valve 650. Closure of the valve 650 vents the line 652 thereby reducing pressure in the venting valve and allowing that valve to close.

An alternative form of venting valve 106 is shown in FIG. 5. The valve differs from that of FIG. 2 in being intended for mounting outside the inflatable buoyancy chamber 100. The passage 745 extends axially through the whole length of control rod 734. A further inlet 700 is provided in the side of the valve opposite the venting passage 725 which in this embodiment operates as an outlet, the venting flow being reversed with respect to FIG. 2. Inlet 700 communicates with the interior of the buoyancy chamber 100 via the openings in diaphragm 728. Inflation air may therefore be injected through inlet 700 from a source of compressed air, e.g. the outlet 816 of the control valve 802 could be connected to this inlet of the venting valve instead of as shown in FIG. 1. Inlet 700 may also be used as an outlet for connection to a line to the sensing inlet 809 of control valve 802. When not in use for these purposes, inlet 700 will be closed by means not shown.

Air pressure applied to inlet 738 will deflect the diaphragm 729 downwardly to open the venting valve because although the applied pressure is communicated to behind diaphragm 728 by the bore 745, the pressure acts on a greater area of diaphragm 729. This valve also acts as a pressure relief valve as excessive air pressure in the inflatable buoyancy chamber is communicated up to above diaphragm 729 via bore 745 and forces the valve open, the line connected to inlet 738 being closed upstream by the ascent control valve to which the venting valve is connected.

In use starting from a hovering condition the buoyancy chamber 100 is partially inflated by air flowing through line 113 until the pressure in the chamber is sufficient to depress diaphragm 804 and shut off the needle jet 812. Typically a pressure about 41 KPa (6 psi) above ambient is desirable. The supply of air through line 113 may be regulated at a much higher pressures, e.g. 690 KPa (100 psi) above ambient. The size of the buoyancy chamber is so chosen with respect to the weight of the whole apparatus that there will now be some small degree of positive buoyancy. The apparatus will begin to ascend. When the rate of ascent is sufficient, the diaphragm of the ascent control valve 801 will deflect and the pressure in the buoyancy chamber will be communicated from valve 801 as an actuating signal to the venting valve 106 causing some of the buoyancy in the chamber to be dumped. This will result in the ascent slowing and valve 801 switching off and dumping. The rate of dumping can be designed to be sufficient to produce overshoot to slight negative buoyancy producing a slight descent. As the pressure in the chamber will have dropped toward ambient, the diaphragm 804 will rise and reinflation of the buoyancy chamber will commence. The apparatus will therefore oscillate gently up and down about a baseline depth. An amplitude of oscillation of only about 30 cm can easily be obtained.

Instead of being used for producing hovering, the apparatus shown in FIG. 1 may be used for producing a controlled amount of buoyancy when the device in which the apparatus is contained is to be held below the surface of water, e.g. on a tethering line, or is to be pulled down through water by means of a tethering line. In use in this mode, the ascent control valve 801 may be disabled as it is not required and where only this mode is to be used, the ascent control valve and the venting valve 106 may be omitted.

By way of illustration, we may suppose the buoyancy chamber 100 was part of an inflatable craft equipped with an anchor line and a winch. To submerge the craft, one may throw down the anchor and deflate the craft until it is just sinking, e.g. by applying a suitable control signal to the venting valve 106 from a manually controllable source of pressure. Application of pressure to the line 113 will result in gradual reinflation of the buoyancy chamber 100. The craft may be winched down through the water to a desired depth. As the craft is winched down, the increasing water pressure will tend to compress the air in the buoyancy chamber 100 so that the craft will progressively lose buoyancy. To counteract this, air will continuously be introduced through the line 113 and the control valve 802. The introduction of too much gas into chamber 100 could lead to excessive upthrust causing the anchor line to part or the anchor to be dragged. This is prevented by the operation of the valve 802 which will prevent further inflation of the chamber 100 when the pressure in the chamber 100 reaches a predetermined value above ambient water pressure.

Figure 6:
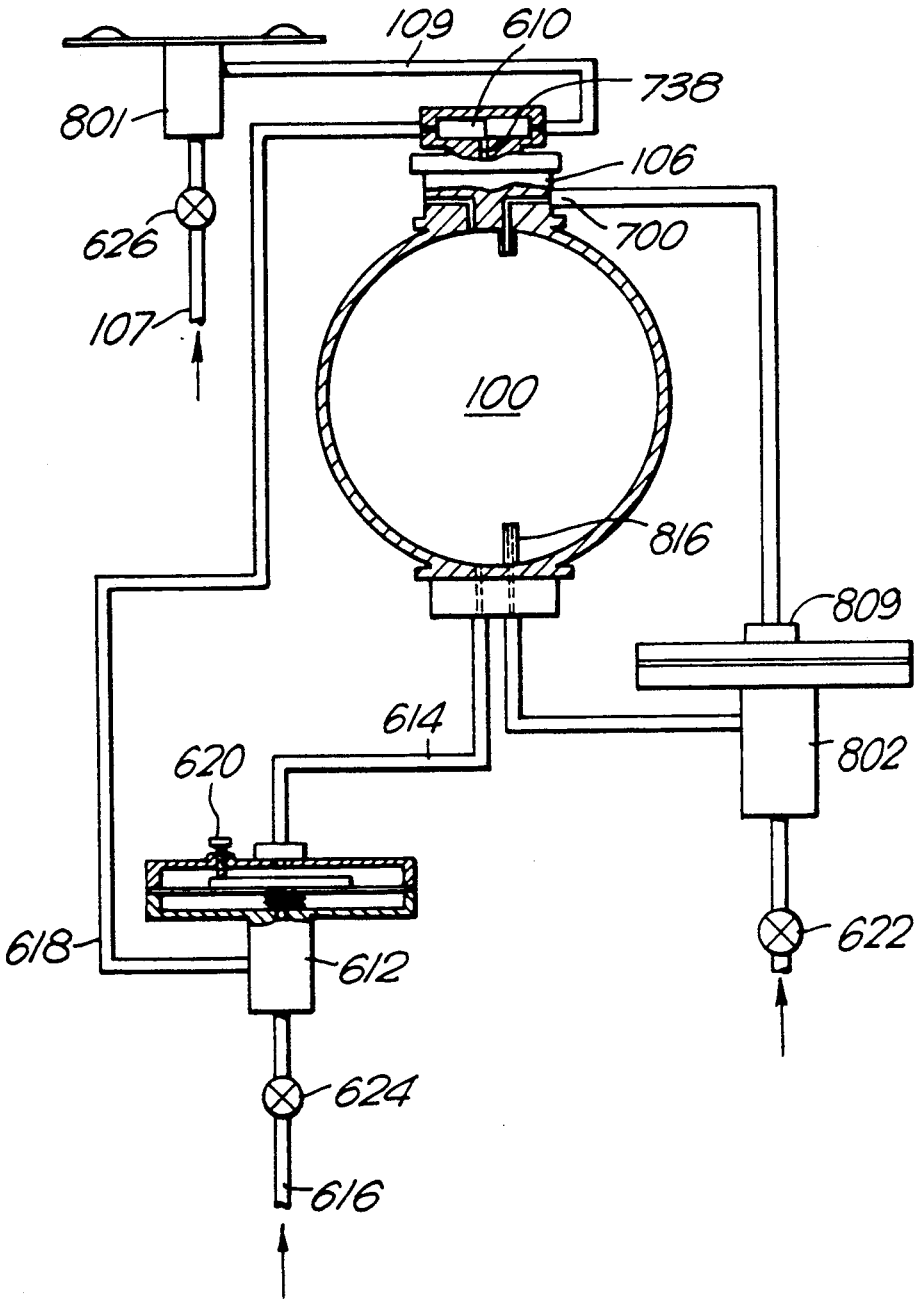
FIG. 6 shows a schematic view of a second embodiment of hovering apparatus according to the invention.

A further embodiment of hovering apparatus according to the invention is shown in FIG. 6. This also may be used in an alternative mode for controlling buoyancy in the manner described above.

In FIG. 6, the buoyancy chamber 100, illustrated as a cross section through a buoyancy tube of the inflatable hull of a water craft, receives air from the outlet 816 of a control valve 802. Chamber 100 is shown fully inflated, but in use during hovering may only be partially inflated. Air pressure in the chamber 100 is fed back to the inlet 809 of the control valve 802 from the top of the chamber 100. An ascent control valve 801 provided with an air supply via a line 107 from a source of compressed gas has an outlet connected via a line 109 to a shuttle valve 610 and via the shuttle valve to the inlet 738 of a venting valve 106 positioned on the top of the buoyancy tube 100. Thus far, the arrangement is as shown in FIG. 1. Additionally, a normally closed variant of the control valve 802 is provided as a pressure limiting valve 612. The sensing inlet of the valve 612 is connected via a line 614 to the air space of the buoyancy tube 100. Compressed air is supplied to the main inlet of the valve 612 from a line 616 and upon opening of the valve 612 is communicated via a line 618 to a second inlet to the shuttle valve 610. The effect of the shuttle valve 610 is to isolate the line 618 from the line 109 whilst allowing pressure applied through either, but not both simultaneously, to be communicated to the inlet 738 of the venting valve 106. Valve 612 is normally closed but is openable through the application of air pressure through the line 614. The amount of air pressure needed to open the valve may be adjusted by adjustment of a manual adjusting bolt 620.

In normal use, the illustrated apparatus will operate in the same manner as that described in FIG. 1. If for any reason the air pressure in the buoyancy tube should rise to a dangerous level, for instance if the ascent control valve should fail to operate the venting valve when the apparatus is rising in the water, air pressure communicated through line 614 will open the normally closed valve 612 allowing air to be communicated through the lines 616 and 618 to the shuttle valve 610 and hence to open the venting valve 106 so as to reduce the rate of ascent and avoid rupturing of the buoyancy tube 100. Each of the air supply lines may be provided with a respective on-off valve as shown at 622, 624 and 626.

Figure 7:
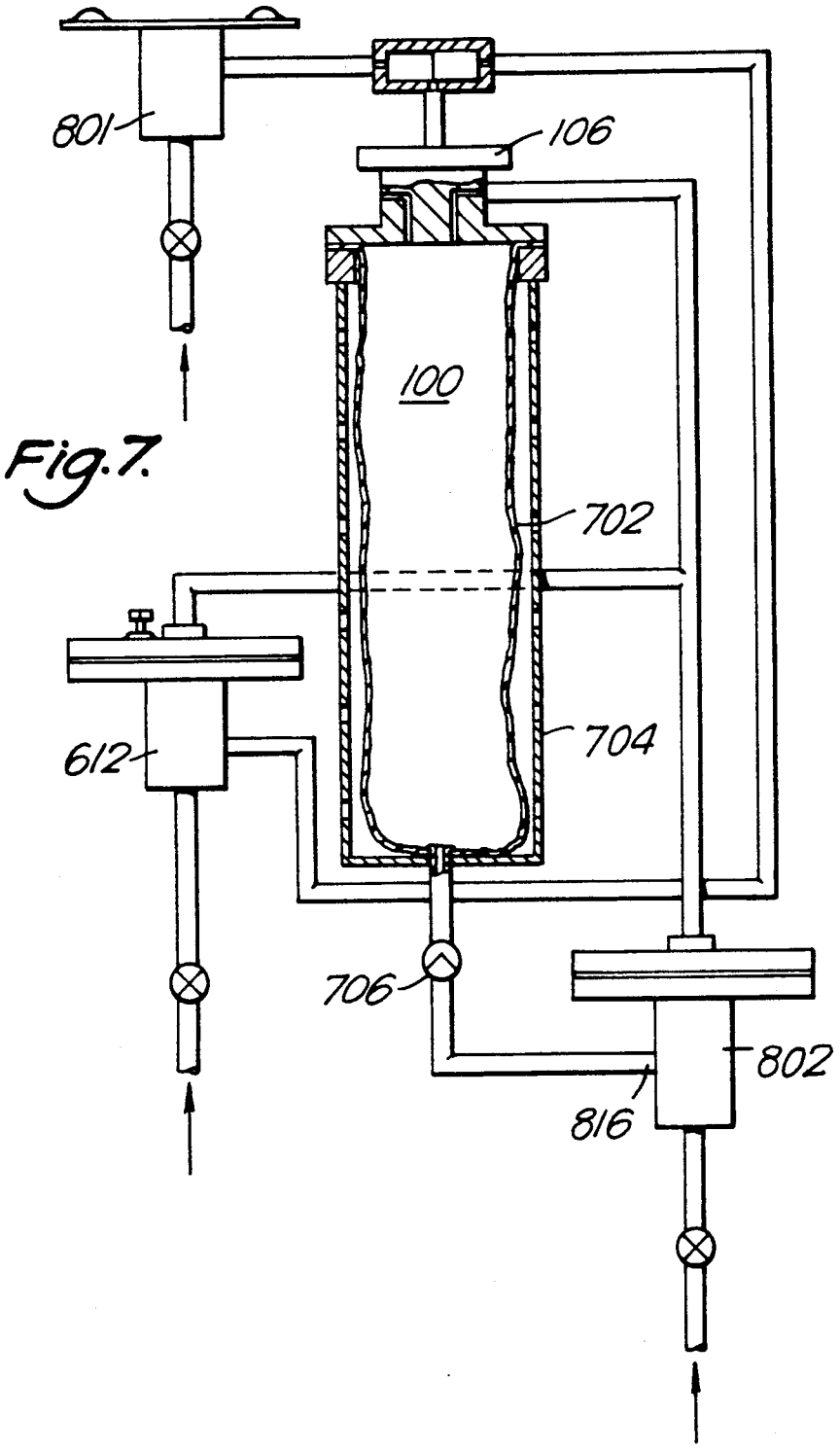
FIG. 7 shows a schematic view of a third embodiment of hovering apparatus according to the invention.

In the embodiment shown if FIG. 7, a similar arrangement is shown modified for use with a buoyancy bag contained within a rigid volume defining enclosure. In FIG. 7, the buoyancy chamber 100 takes the form of an inflatable bag 702 contained within a perforated cylinder 704 having bottom and top closures. The outlet 816 from the pressure limiting valve 802 is connected to the bottom of the buoyancy bag 702 through the base wall of the chamber 704. Lines communicating the interior of the buoyancy bag 702 with the sensing inlets of the valves 802 and 612 are taken from the inlet/outlet 700 of the venting valve 106. A one way valve 706 is provided in the line connecting the outlet of the valve 802 with the bottom of the buoyancy bag 702 allowing flow of air into the bag but not out and back towards the valve 802.

The operation of the embodiment shown in FIG. 7 is the same as that shown in FIG. 6. Additional protection against rupture of the bag is provided by the cylinder 704.

Figure 8:
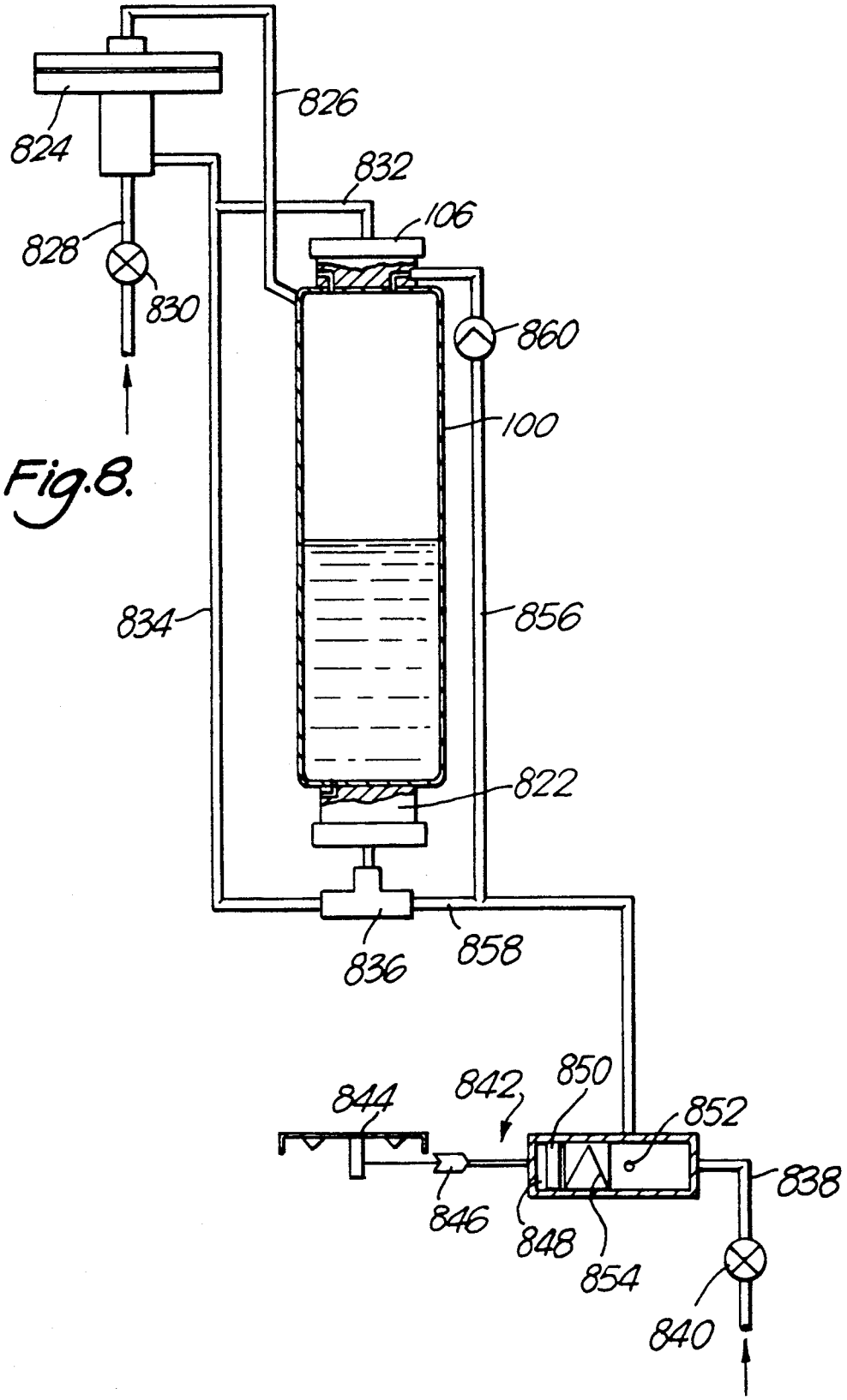
FIG. 8 shows a schematic view of a fourth embodiment of hovering apparatus according to the invention.

The apparatus shown in FIG. 8 shows the principles of the invention applied to a ballast tank of fixed dimensions partly filled with air and acting as the buoyancy chamber of the apparatus. The arrangement is substantially different from that shown in previous figures.

A buoyancy chamber 100 is formed by a rigid hollow cylinder 100 containing air in its upper part and water below. The cylinder is sealed at its upper end by a venting valve 106 and at its lower end by a similar venting valve 822. A gas control valve 824 closely resembling the normally closed gas control valve 612 of FIGS. 6 and 7 has a sensing inlet connected by a line 826 to the air space within the chamber 100. A supply of air to the gas control valve 824 is provided via a line 828 to a supply of compressed air. An on-off valve 830 is provided in the line 828. The outlet from the gas control valve 824 is divided at a T piece into lines 832 and 834. Line 832 connects to the control inlet 738 of the venting valve 106. Line 834 connects via a shuttle valve 836 of the kind described previously with the control inlet of the venting valve 822. A further supply of compressed air is connected through a line 838 containing an on-off valve 840 with the inlet to a descent control valve 842 which has a velocity member 844 exposed to the ambient water and serving when deflected to operate a whisker valve 846 to vent a gas space 848 behind a control piston 850 of the valve 842 causing the valve to close.

The descent control valve 842 may closely resemble the ascent control valve shown in FIG. 4 but in an inverted position.

The outlet from the valve 842 is split at a T piece into lines 856 and 858. Line 856 communicates with the gas space in the buoyancy chamber for the purposes of filling the buoyancy chamber with air. Line 858 communicates with the second inlet of the shuttle valve 836 and thus with the control inlet to the venting valve 822.

In use, if the apparatus is descending through the water, the velocity member 844 will be deflected by the flow of water, the valve 842 will thereby be opened to allow air flow into the buoyancy chamber 100. Simultaneously, the application of pressure through the line 858 and the shuttle valve 836 will open the venting valve 822 to allow water to be displaced from the chamber 100 so that the buoyancy of the apparatus will increase. A one way valve 860 is provided in the line 856 to prevent return flow of air from the buoyancy chamber to the valve 842. An exhaust port 852 in the body of the valve 842 allows the pressure in line 858 to fall when the valve 842 shuts when the whisker valve 846 is reseated.

When the device ceases to descend, the whisker valve 846 will reseat and the valve 842 will close cutting off the air supply to the chamber 100 and allowing the venting valve 822 to close sealing the chamber 100. If the apparatus now commences to rise, the air pressure in the chamber 100 will increase with respect to the ambient water pressure as the water pressure decreases. This increase in pressure will be communicated to the valve 824 through the sensing valve 826 and will cause the valve 824 which is normally closed, to open allowing air to be communicated from the line 828 through the line 832 and the line 834 to open both venting valves 738 and 822. This will allow air to be vented from the chamber 100 and to be replaced with water. As the buoyancy decreases, the excess in air pressure with respect to ambient in the chamber 100 will fall and the valve 824 will shut allowing the venting valves 738 and 822 to shut. If the apparatus rises further, this cycle will be repeated until the apparatus begins to fall when the valve 842 will once again be brought into operation to increase buoyancy.

Figure 9:
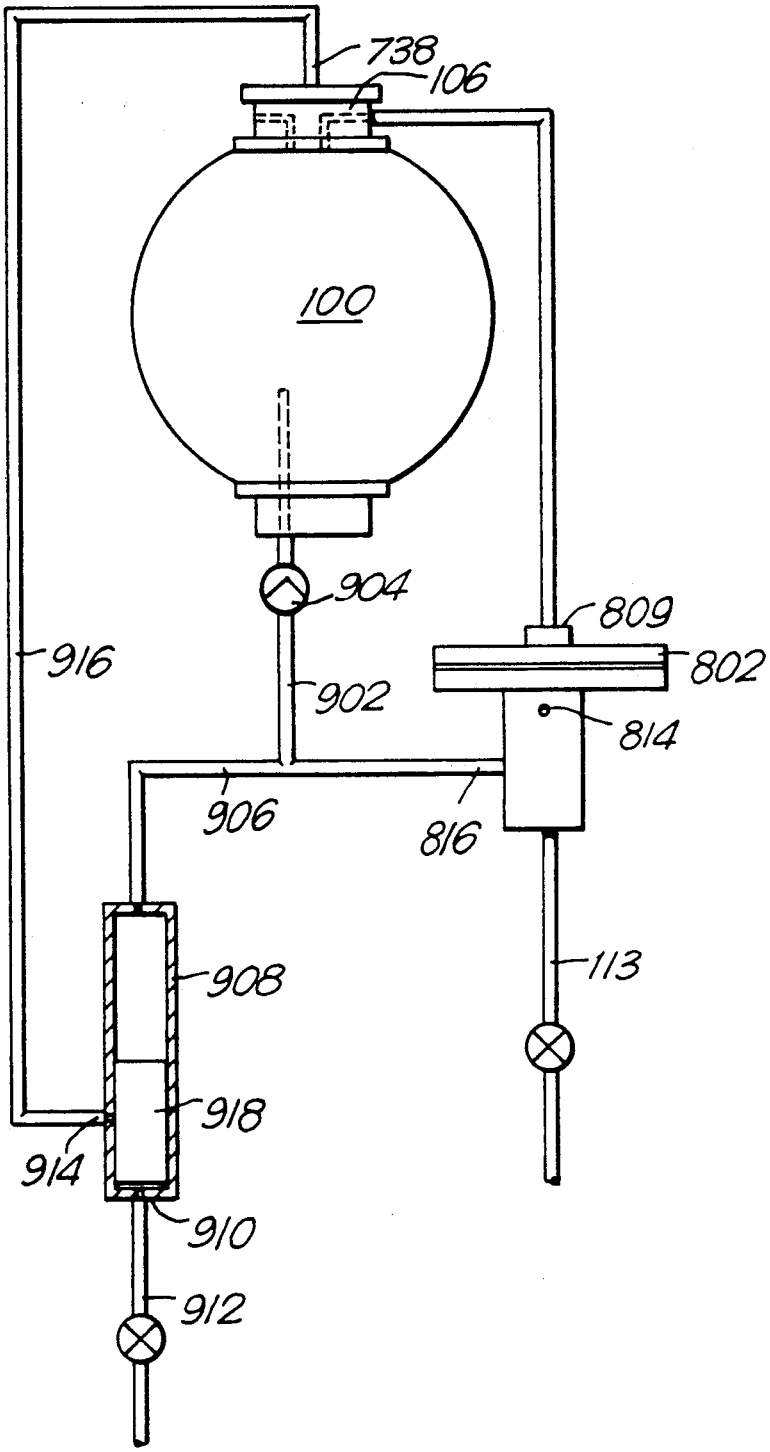
FIG. 9 shows a schematic view of a fifth embodiment of hovering apparatus according to the invention.

The apparatus shown in FIG. 9 is significantly different from the apparatus shown in previous embodiments in that it does not include any velocity sensors.

A control valve 802 as described previously is provided with a connection to a source of compressed air via line 113 and has its outlet 816 connected via a line 902 and a needle valve 904 to the interior of a buoyancy chamber 100. Air pressure in the buoyancy chamber 100 is fed back to the sensing inlet 809 of the valve 802. Tee'd off from the line 902 is a line 906 communicating with a normally open piston valve 908 having an inlet 910 connected to a source of compressed air via a line 912. An outlet 914 from the valve 908 is connected via a line 916 to the operating inlet 738 of a venting valve 106 positioned on the top of the buoyancy chamber 100. Valve 908 in its normally open position allows air to pass from the inlet 910 through the valve body to the outlet 914. The valve contains a piston 918 movable within the valve body against the action of a spring (not shown) to close communication between the inlet 910 and the outlet 914. The body of the valve 802 is provided with an exhaust capillary bore 814 as described with reference to FIG. 1.

In use, air pressure communicated to the valve 802 through the line 113 is passed to the buoyancy chamber 100 to produce inflation via the needle valve 904. The presence of the needle valve 904 produces back pressure in the line 902 and its communicating line 906 which serves to drive down the piston 918 to shut off the valve 908. The buoyancy chamber therefore gradually fills with air until the pressure in the chamber is sufficient to close the valve 802. When the valve 802 closes, pressure in the lines 902 and 906 is lost through the air bleed 814 and the normally open 908 valve opens to allow air flow through the line 916 to operate the venting valve 106 producing progressive deflation of the buoyancy chamber 100. This will continue until the pressure in the buoyancy chamber 100 falls sufficiently to allow the valve 802 to reopen which will both introduce inflating gas through the needle valve 904 and shut off the valve 908 and hence the venting valve 106.

If the rates of venting and introduction of air are correctly adjusted, the device will hover about a mean point in water.

Many modifications and variations of the above embodiment may be made within the scope of the invention. For instance, depending upon the size of the buoyancy chamber 100, and on whether a single ascent control valve is to be used to control venting of air from several such chambers, it may be possible to omit entirely venting valve 106 and to rely upon the outlet of gas from the ascent control valve to provide all the venting action.

It should be appreciated that drag may have an effect on the pressure in the buoyancy chamber during ascent and descent. Tension in the skin of a flexible buoyancy chamber supporting a payload contributes to the air pressure in the chamber. This will increase when the apparatus is hauled down through water or is heavily weighted. This may affect the degree of inflation of the chamber at which the control valve 802 in FIG. 1 shuts down the supply of inflating air.

I claim:

1. Apparatus for producing hovering in water comprising a buoyancy chamber, first valve means for controlling a supply of gas to said buoyancy chamber, second valve means for controlling venting of gas from said chamber, said second valve means comprising a pneumatically actuable venting valve and a gas control valve for sensing the occurrence of a condition in which the gas pressure in said chamber exceeds ambient water pressure by a predetermined amount and for communicating gas from a supply of gas to said pneumatically actuable venting valve to open the venting valve to vent gas from said chamber whilst said condition persists, and means for sensing descent of the apparatus and for actuating said first valve means to release gas into said buoyancy chamber.

2. Apparatus as claimed in claim 1, wherein the means for sensing descent comprises means monitoring the rate of descent sensitive to reactive thrust of water on the said means consequent upon the rate of descent and providing a control signal when the descent speed exceeds a predetermined value, and a gas control valve responsive to said signal to open communication between said supply of gas and said buoyancy chamber.

3. Apparatus for use in controlling buoyancy in water comprising a buoyancy chamber for containing a variable volume of gas, means for supplying buoyancy gas to said chamber, first valve means for controlling said supply of gas, second valve means for controlling venting of gas from said chamber, at least one out of said first and said second valve means comprising a gas control valve having an inlet connected to a gas supply, an outlet for gas from said valve, and a sensing inlet connected to said volume of gas in the buoyancy chamber, and having open and closed positions between which said control valve is shiftable to open or to close a flow path between said gas supply and said outlet in response to a predetermined value of the differential between air pressure in said buoyancy chamber and ambient water pressure at said control valve, said buoyancy chamber being of substantially fixed volume and being provided with third valve means responsive to pneumatic control signals to open a communication between a lower portion of said chamber and ambient water to allow flow of water into and out of said chamber when the volume of gas in said chamber is to be varied.

4. Apparatus as claimed in claim 3 wherein said third valve means has an inlet for receiving said pneumatic actuation signal connected to said outlet of said gas control valve of the first or second valve means.

* * * * *